US005100438A

United States Patent [19]

Kain et al.

[11] Patent Number: 5,100,438

[45] Date of Patent: Mar. 31, 1992

[54] ESTER-AMIDES OF POLYCARBOXYLIC ACIDS AS RHEOLOGICAL ADDITIVES FOR COAL-WATER SLURRIES

[75] Inventors: William S. Kain; Donald D. Staker, both of Cincinnati, Ohio

[73] Assignee: Henkel Corporation, Ambler, Pa.

[21] Appl. No.: 224,598

[22] Filed: Jul. 26, 1988

Related U.S. Application Data

[63] Continuation of Ser. No. 848,603, Apr. 7, 1986, abandoned.

[51] Int. Cl.[5] ..... C10L 1/32

[52] U.S. Cl. ..... 44/280; 44/404; 44/405; 44/406; 44/407; 44/408; 44/410

[58] Field of Search ..... 44/51, 66, 71, 280, 44/404–408, 410; 260/561

[56] References Cited

U.S. PATENT DOCUMENTS

| | | | |
|---|---|---|---|
| Re. 27,582 | 2/1973 | Kahn et al. | 252/49.7 |
| 3,037,056 | 5/1962 | Lowe et al. | 44/66 |
| 3,844,731 | 10/1974 | Biasotti et al. | 44/66 |
| 4,242,098 | 12/1980 | Braun et al. | 44/51 |
| 4,288,232 | 9/1981 | Schmolka et al. | 44/51 |
| 4,392,865 | 7/1983 | Grosse et al. | 44/51 |
| 4,398,919 | 8/1983 | Zakaria | 44/51 |
| 4,634,450 | 1/1987 | Ljusberg-Wahren | 44/51 |

*Primary Examiner*—Margaret Medley
*Attorney, Agent, or Firm*—Ernest G. Szoke; Wayne C. Jaeschke; John E. Drach

[57] ABSTRACT

Coal-water slurries containing a rheological additive are provided. Rheological additives employed for preparation of the coal-water slurries are ester-amide products obtained by reaction of a polycarboxylic acid with a polyether glycol and aliphatic amine. Salts of the ester-amides may also be advantageously employed as dispersants. The ester-amide additives are employed in an amount from about 0.1 to about 4 percent by weight of the slurry. Stable aqueous slurries containing from 60 to 80 percent by weight coal solids are produced.

8 Claims, No Drawings

ESTER-AMIDES OF POLYCARBOXYLIC ACIDS AS RHEOLOGICAL ADDITIVES FOR COAL-WATER SLURRIES

This is a continuation of patent application Ser. No. 848,603, filed Apr. 7, 1986 now abandoned.

BACKGROUND OF THE INVENTION

1. Field of the Invention

This invention relates to coal-water slurries containing a rheological additive which is obtained by the reaction of a polycarboxylic acid with a polyether glycol and an aliphatic amine. The ester-amide products are employed in an amount from about 0.1 to about 4% by weight of the coal-water slurry, the slurry having from about 60 to about 80% by weight solids—the balance being water.

2. Description of the Prior Art

In recent years there has been a great deal of interest in utilizing coal-water slurries in lieu of oil for electric power generation not only because of the lower cost of coal but also because of its availability.

Coal-water slurries have been produced which are fluid and handle in about the same way as petroleum fuels. Since the heat generated during combustion is sufficiently high, these coal-water slurries may be burned directly to generate power without dewatering. As the solids of the coal-water slurry is increased, the fuel value of the slurry also increases and it is generally not considered economically feasible to use slurries having less than about 50 to 55% solids.

One of the difficulties encountered with coal-water slurries at a solids content of about 60% and higher is that the dispersion becomes an immobile mass. Thus, for burning it has to be handled in the same manner as lump coal. Handling in this respect includes not only transportation of the coal from the mine source but also the delivery of the coal to a combustion chamber such as the firebox of a steam boiler. Unless coal-water slurries have the same liquidity as oil at these higher solids content so that they may be transported by pipeline and injected into a firebox by spraying, the advantage of using a liquid carrier (i.e., water) for the coal is lost. Stated otherwise, the particles of coal in the slurry at these higher solids levels tend to convert the liquid carrier (water) into a plastic mass whereby the advantage of employing a liquid carrier is lost.

The prior art has overcome some of these difficulties by providing additives which may be used in relatively small amounts to assure that the coal-water slurry at high solids content is fluid. For example, the use of alkali metal soaps of fatty acids is disclosed in U.S. Pat. No. 4,435,306. Numerous alkoxylated additives, including nitrogen-containing products, are also disclosed to be effective in the formulation of useful coal-water slurries. U.S. Pat. Nos. 4,358,293, 4,441,889, 4,477,259 and 4,478,603, describe the use of block polymers of ethylene and propylene oxide derived from nitrogen-containing compounds, such as ethylene diamine, and having molecular weights of at least about 14,000 as useful dispersants for the preparation of high solids content coal aqueous mixtures. Other nitrogen-containing materials, such as cocamidopropyl betaine and ammonium salts, are also disclosed in U.S. Pat. No. 4,477,259. In U.S. Pat. No. 4,398,919 coal-water slurries are prepared utilizing 0.1 to 0.5 weight percent of an ethoxylated fatty acid amide, such as polyoxyethylene (2) oleamide.

It would be highly advantageous if other additives obtained from readily available and economical materials were available. It would be particularly advantageous if coal-water slurries having high solids contents and which are stable for extended periods of time could be obtained using these additives.

SUMMARY OF THE INVENTION

The present invention relates to coal-water slurries prepared using novel ester-amide rheological additives comprising the reaction product of a polycarboxylic organic acid having from about 16 to 60 carbon atoms and from 2 to 4 carboxyl groups with a polyether glycol having a molecular weight from about 1000 to about 20000 and containing recurring oxyalkylene groups of up to 4 carbon atoms and an aliphatic amine selected from the group consisting of alkylamines having from 4 to 18 carbon atoms and a single primary or secondary amine group, alkanolamines having from 2 to 12 carbon atoms and 1 to 3 hydroxyl groups, and etheramines which are mono- or diamines of ethylene oxide, propylene oxide or mixtures of ethylene and propylene oxide; said polycarboxylic acid having at least 55 percent of the available carboxyl groups reacted and the molar ratio of polyether glycol to aliphatic amine ranging from about 4:1 to 1:4.

Polycarboxylic acids used for the preparation of the ester-amides of the invention are selected from the group consisting of dimer acids, trimer acids, adducts of unsaturated monocarboxylic acids or dimer acids with maleic anhydride in a molar ratio of about 1:1, adducts of linoleic acid or similar unsaturated monocarboxylic acids with acrylic-type acids in a molar ratio of about 1:1, and adducts of olefins having about 12 to about 40 carbon atoms with maleic acid or maleic anhydride in a molar ratio of about 1:1.

The polyether glycol is selected from the group consisting of polyethylene glycol, polypropylene glycol, and poly(ethylene-propylene) glycol. Polyethylene glycol having a molecular weight from about 3,000 to 12,000 is particularly useful for the preparation of the rheological additives of this invention.

Especially useful aliphatic amines are selected from the group consisting of 2-ethylhexylamine, dodecylamine, and N,N-dimethyl-1,3-diaminopropane; an alkanolamine selected from the group consisting of ethanolamine, diethanolamine, N-methyl ethanolamine, N-ethyl ethanolamine, isopropanolamine, diisopropanolamine, N-methyl isopropanolamine, N-ethyl isopropanolamine, and N-aminoethylethanolamine; or an etheramine selected from the group consisting of polyether monoamines of the formula $$R\text{-}\left(CH_2\underset{\underset{R'}{|}}{C}HO\right)_n CH_2\underset{\underset{CH_3}{|}}{C}HNH_2$$

where R is a radical selected from the group consisting of n—$C_{10\text{-}12}H_{21\text{-}25}O$—, n—$C_4H_9OCH_2CH_2O$—, and $CH_3OCH_2CH_2O$—, R′ is hydrogen or methyl, and n is an integer such that the average molecular weight is in the range 300 to 1,000, polyether diamines of the formula

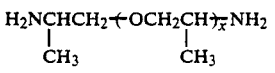

where x is an integer such that the average molecular weight is in the range 200 to 1,000, and polyether diamines of the formula

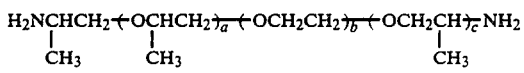

where a, b, and c are integers greater than 1 and such that the average molecular weight is 500 to 6,000.

The resulting ester-amide products typically have more than 55 percent and, more generally, greater than 75 percent of the carboxyl functionality reacted. In one embodiment of the invention, all or a portion of any of the remaining groups which are not reacted to form ester or amide moieties are converted to a salt form. The salts can be amine salts wherein the amine is the same amine or different than that employed for the amide reaction, salts of ammonia and group IA or IIA metals, especially sodium or potassium, or mixtures of said salts.

DETAILED DESCRIPTION OF THE INVENTION

The rheological additives used for this invention are predominantly ester-amide products obtained by reacting a polycarboxylic acid with a polyether glycol and aliphatic amine. The polycarboxylic acid can be completely reacted or, as is more generally the case, a portion of the carboxyl moieties can be unreacted. In preparing the ester-amide compositions, the polycarboxylic acid may be reacted with a mixture of the polyether glycol and aliphatic amine or, as is more generally the case, the reactions may be carried out in a sequential, i.e., stepwise, manner.

Polycarboxylic organic acids employed to obtain the ester-amide products of the invention have from about 16 to about 60 and, more preferably, from 21 to about 54, carbon atoms, and contain from 2 up to about 4 carboxyl groups. The acids may be either dimer acids, trimer acids, adducts of unsaturated monocarboxylic acids or dimer acids with maleic anhydride in a molar ratio of about 1:1, adducts of linoleic acid and similar unsaturated monocarboxylic acids with acrylic-type acids in a molar ratio of about 1:1, or adducts of olefins having about 12 to about 40 carbon atoms with maleic acid or maleic anhydride in a molar ratio of about 1:1.

Dimer acids are known in the art and are described by Barrett et al. in U.S. Pat. No. 2,793,220 and Myers et al. U.S. Pat. No. 2,955,121 which are incorporated herein by reference. Trimer acids are also known in the art and are described by Barrett et al. in U.S. Pat. No. 3,097,220 which is incorporated herein by reference. The dimer acid is obtained by oligomerizing an unsaturated 18 carbon atom naturally occurring unsaturated acyclic monocarboxylic fatty acid such as oleic acid, linoleic acid, linolenic acid and the like to obtain a 36 carbon atom dicarboxylic acid whereas the trimer acid is obtained by oligomerizing the foregoing unsaturated monocarboxylic acids to obtain a 54 carbon atom tricarboxylic acid. In both of these reactions, other products are obtained; however, the reaction is conducted in a manner so that the reaction product is principally the dimeric or the trimeric acid. Other unsaturated acyclic monocarboxylic acids having at least one ethylenically unsaturated position and from about 10 to about 22 carbon atoms can also be used to obtain polycarboxylic acids used in the invention. These include decenoic, undecenoic, pentadecenoic, hexadecenoic acids and the like. Unsaturated acyclic monocarboxylic acids of the above types may be obtained from natural fats and oils such as tall oil, linseed oil, tung oil, soy oil, rapeseed oil, corn oil, fish oil, beef tallow and mixtures thereof.

Dimer acids prepared as described in the foregoing references containing 75% or more of dimer acid and trimer acids prepared according to the foregoing references having 60% or more of trimer acids are especially advantageous polycarboxylic acids for the preparation of the ester-amide additives. Mixtures of dimer acid and trimer acid are also useful and may be advantageously employed.

Adducts of maleic anhydride (or acid) with unsaturated monocarboxylic acids and dimer acids are known in the art and are described in U.S. Pat. Nos. 2,902,499 and 2,975,133 which are incorporated herein by reference. These adducts are prepared by heating maleic anhydride and an unsaturated acid at a temperature from about 100° C. to about 300° C. until the addition reaction is completed. The molar ratio of the maleic anhydride to unsaturated acid is generally about 1:1.

The 21 carbon atom dicarboxylic acid which is the addition product of an 18 carbon atom monocarboxylic unsaturated acid (linoleic acid) and acrylic acid and designated Westvaco 1550 (trademark) may be employed as the polycarboxylic acid. Equivalent unsaturated monocarboxylic acids having at least two ethylenically unsaturated positions and from about 10 to about 22 carbon atoms reacted with an acrylic-type acid to produce a dicarboxylic acid may also be employed as the polycarboxylic acid. Other acrylic-type acids which may be used include crotonic acid, isocrotonic acid, vinylacetic acid, methacrylic acid and the like and mixtures thereof.

Useful polycarboxylic acids can also include adducts of maleic acid or maleic anhydride with an olefin, where the olefin has from about 12 to 40 carbon atoms and one or two unsaturated positions.

A polyether glycol, i.e., poly(lower oxyalkylene) glycol, is reacted with a portion of the carboxyl groups of the above-described polycarboxylic acids to obtain the useful additives of the present invention. The molecular weight of the polyether glycol ranges from about 1,000 to about 20,000 and, more preferably, from about 3,000 to about 12,000. The recurring oxyalkylene groups contain up to about 4 carbon atoms and preferably have from 2 to 3 carbon atoms. Polyethylene glycol having a molecular weight from about 3,000 to about 12,000 is particularly useful for the preparation of the rheological additives of the present invention, however, polypropylene glycol and poly(ethylene-propylene) glycols within the above-described molecular weight ranges are also useful.

The polyether glycols may have either a broad or a narrow molecular weight distribution so long as the molecular weight, on average, is within the aforementioned ranges. These ranges apply not only to polyether glycols falling within the range, but also to polyether glycol mixtures having an average molecular weight within the aforesaid range. Commercial glycols employed according to the present invention are within the aforementioned molecular weight ranges and the molecular weights thereof are average molecular weights. Some commercial polyethylene glycols that may be employed according to the present invention have average molecular weights of 1000, 3350, 8000, and 20000 and are sold under the trademark Carbowax 1000, 3350, 8000 and 20000, respectively.

Lower alkoxy poly(lower oxyalkylene) glycols, i.e., wherein one of the terminal hydroxyl groups is "capped" with an alkyl group having from 1 to about 4 carbon atoms may also be advantageously used. These lower alkoxy poly(lower oxyalkylene) glycols also are within the molecular weight range as defined above for the polyether glycols. The terminal hydroxyl group generally is "capped" with a methyl group, such as methoxypolyethylene glycol.

Mixtures of the above-described polyether glycols may also be used.

In addition to the polyether glycol, an aliphatic amine is also reacted with a portion of the carboxyl functionality of the polycarboxylic acid. Aliphatic amines which can be used to obtain the additives of this invention include alkylamines, alkanolamines, and ether amines. The alkylamines can contain from 4 to 18 carbon atoms and have at least one primary or secondary reactive amine group. One or more tertiary amine groups can also be present. Alkylamines having from 6 to 12 carbon atoms are especially advantageous, and highly efficient additives for coal-water slurries are obtained using 2-ethylhexylamine, dodecylamine, and N,N-dimethyl-1,3-diaminopropane (N,N-dimethylaminopropylamine).

Useful alkanolamines have at least one reactive primary or secondary amine group. Tertiary amine groups may also be present. The alkanolamines generally contain from 2 to 12 and, more preferably, 2 to 8 carbon atoms. They can have from 1 to 3 hydroxyl groups. Useful alkanolamines for the preparation of the additives of this invention include ethanolamine, diethanolamine, N-methyl ethanolamine, N-ethyl ethanolamine, isopropanolamine, diisopropanolamine, N-methyl isopropanolamine, N-ethyl isopropanolamine, and N-aminoethylethanolamine.

Etheramines can be mono- or diamines based on propylene oxide, ethylene oxide, or mixtures of ethylene oxide and propylene oxides. These include polyether monoamines corresponding to the structural formula $$R\text{-}(CH_2\underset{\underset{R'}{|}}{C}HO)_n\text{-}CH_2\underset{\underset{CH_3}{|}}{C}HNH_2 \quad \text{(I)}$$

where R is a radical selected from the group consisting of n—$C_{10\text{-}12}H_{21\text{-}25}O$—, n—$C_4H_9OCH_2CH_2O$—, and $CH_3OCH_2CH_2O$—, R' is hydrogen or methyl, and n is an integer such that the average molecular weight is in the range 300 to 1,000. Polyether monoamines of the above type are commercially available under the Jeffamine (trademark) M-series designation.

Useful polyether diamines correspond to the structural formulae $$H_2N\underset{\underset{CH_3}{|}}{C}HCH_2\text{-}(OCH_2\underset{\underset{CH_3}{|}}{C}H)_x\text{-}NH_2 \quad \text{(II)}$$

and

-continued $$H_2N\underset{\underset{CH_3}{|}}{C}HCH_2\text{-}(O\underset{\underset{CH_3}{|}}{C}HCH_2)_a\text{-}(OCH_2CH_2)_b\text{-}(OCH_2\underset{\underset{CH_3}{|}}{C}H)_c\text{-}NH_2 \quad \text{(III)}$$

where x is an integer such that the average molecular weight is in the range 200 to 1,000 and a, b, and c are all integers greater than one and such that the average molecular weight is 500 to 6,000 and, more preferably, 600 to 4,000. Polyether diamines of the above types are commercially available under the Jeffamine (trademark) D-series and ED-series designations, respectively.

The ester-amide rheological additives used for the present invention are reaction products of the aforementioned polycarboxylic acids, polyether glycols, and aliphatic amines and are obtained in accordance with known conventional reaction procedures. All of the reactants may be added to the reactor as a unit charge and reacted or the polycarboxylic acid can be partially reacted with one of the reactants and then, in a subsequent step, be further reacted with the second reactant. In the latter situation, i.e., sequential reaction, the two steps may be carried out under different conditions. Since higher temperatures are required for ester formation, the polycarboxylic acid is generally first reacted with the polyether glycol and the resulting partial ester product then reacted with the aliphatic amine. This is particularly advantageous when a low boiling amine is used. Polymerization is avoided or minimized by controlling the degree of reaction and the molar ratio of reactants.

The additives of this invention necessarily contain both ester and amide functionality. There may also be unreacted carboxyl groups present. While essentially all of the carboxyl groups of the polycarboxylic acid can be reacted, some unreacted carboxyl moieties can remain, i.e., the reaction product will have a measurable acid value (AV). Also, where there is unreacted carboxyl functionality amine salts of the aliphatic amine can be formed. In virtually all instances some amine salt will be present. This is particularly so if reaction with the aliphatic amine to form the amide is not carried to completion. Thus, as used herein the term "reaction product" is intended to encompass not only those products where all the amine is reacted with the available carboxyl groups to form amide linkages but also those products where a portion of the amine is reacted to the amide and all or a portion of the remaining carboxyl groups are associated with the amine in the form of a salt.

Acid value is generally used to follow the progress of the reaction and determine the extent of reaction of the polycarboxylic acid. The presence of unreacted carboxyl functionality is not detrimental to the performance of the ester-amide as an additive for the coal-water slurries, in fact, it can be advantageous with certain types of coal.

To obtain the useful ester-amide products of this invention, at least 55 percent and up to 100 percent of the available carboxyl functionality of the polycarboxylic acid is reacted. These percentages are based on the acid value of the final product versus the acid value of the reactant mixture. Most generally, and particularly when di- and tricarboxylic acids are employed, about 70 to 99 percent of the carboxyl functionality is reacted with the polyether glycol and aliphatic amine, i.e., converted to ester and amide. In a particularly useful embodiment of the invention 90 to 99 percent of the carboxyl groups of the polycarboxylic acid are converted to ester and amide. The ratio of polyether glycol to aliphatic amine ranges from about 4:1 to 1:4 but is more generally in the range 2:1 to 1:2, on a molar basis.

In addition to the amine salts of the ester-amide products, in another embodiment of the invention all or a portion of any carboxylic acid groups remaining after reaction with the polyether glycol and aliphatic amine are converted to other salt forms. These ester-amide salts are also useful as rheological additives for the preparation of stable high solids content coal-water slurries. The salts can be salts of ammonia, organic amines different than those reacted with the polycarboxylic acid, or Group IA or Group IIA metals of the Periodic Table of the Elements, particularly sodium or potassium. In addition to the organic amines which have been previously described, i.e., alkylamines, alkanolamines, and etheramines, salts of other amines, such as aromatic amines, and heterocyclic nitrogen-containing compounds, such as pyridine, piperidine, piperazine, morpholine, and alkyl-substituted imidazolines, are also possible. Mixtures of these salts can also be used.

Especially advantageous rheological stabilizers of the invention are:

A. Ester-amides of a dimer acid wherein approximately one-half of the carboxyl groups are esterified with a polyethylene glycol having a molecular weight from about 3,000 to about 12,000, and all or a portion of the remaining carboxyl groups are reacted with an aliphatic amine selected from 2-ethylhexylamine; dodecylamine; N,N-dimethylaminopropylamine; ethanolamine; diethanolamine; N-aminoethylethanolamine; polyether monoamines of type (I) where R is a radical selected from the group consisting of n—$C_{10-12}H_{21-25}O$—, n—$C_4H_9OCH_2CH_2O$—, and $CH_3OCH_2CH_2O$—, R′ is hydrogen or methyl, and n is an integer such that the average molecular weight is in the range 300 to 1,000; polyether diamines of type (II) where x is an integer such that the average molecular weight is in the range 200 to 1,000; and polyether diamines of type (III) wherein a, b, and c are integers greater than 1 such that the average molecular weight is in the range 600 to 4,000;

B. Ester-amides of trimer acid wherein approximately one-third to two-thirds of the carboxyl groups of the trimer acid are esterified with a polyethylene glycol having a molecular weight from about 3,000 to about 12,000 and all or a portion of the remaining carboxyl groups are reacted with an aliphatic amine selected from 2-ethylhexylamine; dodecylamine; N,N-dimethylaminopropylamine; ethanolamine; diethanolamine; N,N-dimethylaminopropylamine; polyether monoamines of type (I) where R is a radical selected from the group consisting of n—$C_{10-12}H_{21-25}O$—, n—$C_4H_9OCH_2CH_2O$—, and $CH_3OCH_2CH_2O$—, R′ is hydrogen or methyl, and n is an integer such that the average molecular weight is in the range 300 to 1,000; polyether diamines of type (II) where x is an integer such that the average molecular weight is in the range 600 to 4,000; and C. Amine, ammonium or alkali metal salts of A and B.

The coal-water slurries of the present invention are made from pulverized or powdered coal which has a particle size such that about 60% to about 90% will pass through a 200 mesh U.S. standard screen (a 75 micron sieve). Powdered or pulverized coal that may be converted into a water slurry is generally described by Funk in U.S. Pat. Nos. 4,282,006 and 4,416,666 both of which are incorporated herein by reference. The mixing of the powdered coal with water to form a slurry is also described by Funk in U.S. Pat. No. 4,477,260 at column 21, the entire disclosure of this reference being incorporated herein by reference. The rheological additives of the present invention are combined with water and the water in turn is mixed with the coal in a mixer such as a Hobart (trademark) mixer or the various art known equivalents thereof.

About 0.1% to about 4% and, more preferably, 0.25 to 2.0% by weight, based on total slurry, of the ester-amide additive is employed to obtain coal-water slurries having from about 60 to about 80% solids by weight. As a result of the use of the rheological additives, the resulting slurries are liquid at room temperature and easily pourable. Without the additives, the coal-water slurry is a non-pourable mass that is solid at room temperature. The slurries of the invention are generally maintained from about 0° C. up to about 95° C. and, more preferably, from about 2° C. to about 75° C.

The following Examples are illustrative.

EXAMPLE I

An ester-amide was prepared by first preparing a partial ester and then further reacting with an etheramine. The partial ester was obtained by reacting polyethylene glycol having an average molecular weight of 3350 (PEG 3350) and dimer acid. The dimer acid was a dimerized linoleic acid produced by Emery Chemicals (AV 189-197; SV 191-199; dibasic acid 77%). For the reaction, 176.7 g (0.6142 equivalent) dimer acid and 1028.8 g (0.6142 equivalent) PEG 3350 were charged to a two-liter four-necked round bottom flask equipped with nitrogen inlet tube, thermometer, and water trap. The reaction was run at 200° C. for 11 hours resulting in a drop in acid value of from 28.5 for the starting blend to 15.8.

A portion of the partial ester prepared above was then further reacted with the etheramine to obtain the ester-amide product. For the reaction 38.6 grams (0.0099 equivalent) of the partial ester and 39.5 grams (0.0099 mole) polyether diamine having an average molecular weight of 4,000 (Jeffamine ® ED-4000) were combined in a 250 ml glass reactor equipped with a subsurface nitrogen inlet, thermometer and water trap. The reaction mixture (acid value approximately 7.8) was heated at 180°–185° C. for three hours while continuously removing water. When the acid value of the reaction mixture reached 4.1 heating was terminated and the reaction mixture was allowed to cool.

The resulting ester-amide product was evaluated as a rheological additive as follows: 1.75 g of the ester-amide was dissolved in 61.5 grams of tap water with 0.18 g commercial defoamer and 4.38 g of a 1% aqueous solution of xanthan gum and 0.5% formaldehyde in the bowl of a Hobart mixer. The mixer bowl was then charged with 177.0 grams of freshly milled low-ash, low-sulfur Kanawha County West Virginia bituminous coal. This coal 98.8% dry matter was milled to 98.0% smaller than 50 mesh (300 microns), 73.5% smaller than 200 mesh (75 microns), 68.6% smaller than 230 mesh (65 microns), and 61.1% smaller than 325 mesh (45 microns). The coal had an ash content of 7.14% and sulfur content of 0.65% dry basis. The dispersant, additives and coal were allowed to mix at low speed (No. 1) for approximately 1 hour. Small water additions were made to account for evaporative losses.

The coal-water slurry was transferred to an 8-ounce bottle for viscosity determination using a Brookfield Viscometer LVF with a Helipath stand adaptor and an F spindle. Viscosity readings were made over a two inch volume of the slurry and averaged. The Brookfield viscometer was also used to measure a series of conventional viscosities using a number 4 spindle without the Helipath stand. Solids content of the slurry was determined by evaporation of water from a weighed portion of the slurry and found to be 72.2% solids. pH was determined with a Cole Parmer pH Wand and found to be 6.53. The viscosity at 6 rpm using the Helipath stand was initially 10,900 centipoise (cP) and 1100 cP at 60 rpm by conventional determination. After 7 days no separation or settling was observed. The viscosity after 7 days was 8,200 cP at 6 rpm with the Helipath stand and 700 cP at 60 rpm by conventional means.

EXAMPLE II

In a manner similar to that of Example I, PEG 3350 was reacted with a commercial trimer acid (trimerized linoleic acid produced by Emery Chemicals; AV 175-192; SV 192-200; tribasic acid 80%). Approximately one-third of the carboxyl groups of the polycarboxylic acid was esterified with PEG 3350. For the reaction, 214.5 g (0.7072 equivalent) of the trimer acid and 789.7 g (0.2357 mole) PEG 3350 were charged to a 2 liter four-necked round bottom flask equipped with nitrogen inlet tube, thermometer and water trap and reacted at 200° C. for 7 hours until the acid value dropped from 34.5 to 25.0.

237.4 g (0.0560 mole) of the above partial ester was transferred to a 500 ml four-necked round bottom flask and 15.9 g (0.1232 mole) of 2-ethylhexylamine charged thereto. The reaction mixture (AV 23.4) was heated to 185° C. for about 24 hours while removing water. The resulting ester-amide product had an acid value of 8.8.

To a Hobart mixer bowl were charged 1.75 grams of the above-prepared ester-amide dispersant, 4.38 g of a 1% aqueous solution of xanthan gum with 0.5% formaldehyde, 0.18 g defoamer and 62.19 g tap water. The dispersant was dissolved and 177.0 g (98.8% dry matter) low-ash, low-sulfur Kanawha County West Virginia bituminous coal added. The dispersant, additives and coal were allowed to mix at low speed (No. 1) for approximately 1 hour. Small adjustments of water were made to account for evaporative losses.

The slurry was transferred to an 8-ounce bottle and viscosity determinations were made as previously described above. The solids content of the slurry was determined to be 72.55%. The viscosity at 6 rpm with the Helipath stand was initially 4700 cP and 1000 cP by conventional methods at 60 rpm. After 7 days' storage, no separation or settling was observed and the viscosity was found to be 13,300 cP at 6 rpm with the Helipath stand and 1200 cP by conventional methods at 60 rpm.

EXAMPLE III

Example I was repeated except that the molecular weight of the polyether diamine was varied. The partial ester was derived from dimer acid and PEG 3350 and had approximately one-half the carboxyl functionality reacted. About 1.1 mole polyether diamine was then reacted as described per equivalent (1 molar on average) of free carboxyl. Two ester-amides were prepared—Product IIIA (AV 1.4) derived from a polyether diamine having an average molecular weight of 600 (Jeffamine® ED-600) and product IIIB (AV 4.4) derived from a polyether diamine having an average molecular weight of 900 (Jeffamine® ED-900). Aqueous coal-water slurries were prepared using ester-amide products IIIA and IIIB at a one percent level (based on coal weight). Kanawha County West Virginia coal and supplemental additives were employed in the formulation of the slurries as previously described. The respective slurries had solids contents of 68.8 and 72.4 percent, respectively. Viscosities (in cP) of the slurries were as follows:

| | Viscosity | | | |
|---|---|---|---|---|
| | Initial | | After 7 Days | |
| | 6 rpm Helipath | 60 rpm Conventional | 6 rpm Helipath | 60 rpm Conventional |
| IIIA | 32800 | 950 | 76400 | 1000 |
| IIIB | 1600 | 900 | 18700 | 1300 |

Even after seven days there was no evidence of phase separation with the slurry prepared using product IIIB.

EXAMPLE IV

To further demonstrate the versatility of the invention, ester-amides useful as additives for the preparation of stable aqueous coal-water slurries and derived from dimer acid, polyethylene glycol, and polyether monoamine were prepared. The ester-amide was obtained by first preparing the partial ester and then subsequently reacting with the polyether monoamine. The partial ester of Example I was used. For the reaction, 234.4 grams (0.0600 equivalent) partial ester was combined with 18.3 grams (0.0660 mole) polyether monoamine having an average molecular weight of 300 (Jeffamine® M-300) and reacted at 185° C. to an acid value of 8.5. A coal-water slurry (72.7% solids) was prepared utilizing 1% of the ester-amide product. The slurry had an initial viscosity of 7000 cP at 6 rpm with the Helipath stand and 2100 cP at 60 rpm using the conventional method. There was no visible phase separation after two days' storage under ambient conditions. The viscosity of the slurry after seven days was 4700 cP at 6 rpm with the Helipath stand and 1100 cP by conventional methods (60 rpm).

EXAMPLE V

Example II was repeated except that the partial ester used was the partial ester of Example I. The ester-amide was obtained by reacting 243.1 grams (0.0622 equivalent) of the partial ester with 8.8 grams (0.0684 mole) 2-ethylhexylamine at 150° C. After 4 hours reaction, a portion of the reaction mixture (AV 8.22) was removed and the product (identified as VA) used to prepare a coal-water slurry. The reaction was continued until an acid value of 7.35 was achieved and this product was also used for the preparation of an aqueous coal slurry. The slurries obtained using both products were stable after seven days' storage and there was no evidence of phase separation. Viscosities of the slurries were as follows:

| | Viscosity | | | |
|---|---|---|---|---|
| | Initial | | After 7 Days | |
| | 6 rpm Helipath | 60 rpm Conventional | 6 rpm Helipath | 60 rpm Conventional |
| VA | 3100 | 1200 | 39800 | 2400 |

-continued

| | Viscosity | | | |
|---|---|---|---|---|
| | Initial | | After 7 Days | |
| | 6 rpm Helipath | 60 rpm Conventional | 6 rpm Helipath | 60 rpm Conventional |
| VB | 8600 | 1400 | 25700 | 1500 |

EXAMPLE VI

To demonstrate the effectiveness of the salt forms of the ester-amide products, the partial ester of Example I (246.4 grams; 0.0631 equivalent) was reacted with 5.14 grams (0.0693 mole) N,N-dimethyl-1,3-diaminopropane at 130° C. to an acid value of about 9.5. 1.75 Grams of the resulting product was dissolved in 61.5 grams water and the pH of the solution adjusted to 9.5 by the addition of N,N-dimethyl-1,3-diaminopropane. The solution containing the salt form of the ester-amide was utilized as an additive for the preparation of an aqueous coal slurry (72.2% solids). The initial viscosity of the slurry was 7000 cP (6 rpm Helipath) and 1100 cP (60 rpm conventional). After seven days' storage, the respective viscosities were 8600 cP and 1500 cP.

EXAMPLE VII

An ester-amide dispersant prepared by reacting 238.9 grams (0.0611 equivalent) of a half-ester of dimer acid and PEG 3350 with 13.4 grams (0.0672 mole) dodecylamine was evaluated as an additive for coal-water slurries. Slurries (72.6% solids) prepared in the conventional manner using the ester-amide product (AV 4.66) had viscosities of 5500 cP (6 rpm Helipath) and 1800 cP (60 rpm conventional) after seven days.

EXAMPLE VIII

To further demonstrate the versatility of the invention and the utility of ester-amide salts for the preparation of stable aqueous coal slurries, ammonium salts of the products of Examples II and IV were prepared. The salts were obtained by dissolving 1.75 grams of the ester-amide in 62.2 grams water and adjusting the pH of the solution by the addition of ammonium hydroxide to 10.1 and 7.3, respectively. Coal-water slurries were prepared in accordance with the standard procedure and viscosities obtained were as follows:

| | Viscosity | | | |
|---|---|---|---|---|
| | Initial | | After 7 Days | |
| | 6 rpm Helipath | 60 rpm Conventional | 6 rpm Helipath | 60 rpm Conventional |
| Salt of Ex. II | 10900 | 1000 | 10900 | 1000 |
| Salt of Ex. IV | 14000 | 750 | 12500 | 1000 |

EXAMPLE IX

An ester-amide was prepared by reacting the partial ester of Example I with a polyether diamine having an average molecular weight of about 230 (Jeffamine® D-230). The ester-amide product had an acid value of 3.5 and was used at a 2 percent level (based on weight of coal to prepare a coal-water slurry having 73.1 percent solids. The slurry had an initial viscosity of 6200 cP (6 rpm Helipath) and 2000 cP (60 rpm conventional). The slurries were stable upon storage and there was no evidence of phase separation after seven days. Slurry viscosities after seven days were 12500 cP (6 rpm Helipath) and 1700 cP (60 rpm conventional).

When the above experiment was repeated using a polyether diamine having an average molecular weight of 400, initial slurry viscosities of 9400 cP (6 rpm Helipath) and 1400 cP (60 rpm conventional) were obtained. Seven-day viscosities obtained using the latter ester-amide product were 13300 cP and 1500 cP.

What is claimed is:

1. A coal-water slurry containing from about 0.25 to 2.0 percent of a rheological additive consisting essentially of an esteramide of a dimer acid wherein approximately one-half of the carboxyl groups are esterified with a polyethylene glycol having a molecular weight of from about 3,000 to about 12,000 and a first portion of the remaining carboxyl groups are reacted with an aliphatic amine selected from the group consisting of 2-ethylhexylamine, dodecylamine, and N,N-dimethyl-1,3-diaminopropane; an alkanolamine selected from the group consisting of ethanolamine, diethanolamine, N-methyl ethanolamine, N-ethyl ethanolamine, isopropanolamine, diisopropanolamine, N-methyl isopropanolamine, N-ethyl isopropanolamine, and N-aminoethylethanolamine; or an etheramine selected from the group consisting of polyether monoamines of the formula $$R-(CH_2-\underset{\underset{R'}{|}}{CHO})_n-CH_2-\underset{\underset{CH_3}{|}}{CH}-NH_2$$

where R is a radical selected from the group consisting of n—$C_{10-12}H_{21-25}O$—, n—$C_4H_9OCH_2CH_2O$—, and $CH_3OCH_2CH_2O$—, R' is hydrogen or methyl, and n is an integer such that the average molecular weight is in the range 300 to 1,000, polyether diamines of the formula $$H_2N\underset{\underset{CH_3}{|}}{CH}CH_2-(OCH_2\underset{\underset{CH_3}{|}}{CH})_xNH_2$$

where x is an integer such that the average molecular weight is in the range 200 to 1,000, polyether diamines of the formula $$H_2N-\underset{\underset{CH_3}{|}}{CH}-CH_2-(O-\underset{\underset{CH_3}{|}}{CH}-CH_2)_a-(O-CH_2-CH_2)_b-$$

$$-(O-CH_2-\underset{\underset{CH_3}{|}}{CH})_c-NH_2$$

where a, b, and c are integers greater than 1 such that the average molecular weight is in the range 500 to 6,000; and a second portion of the remaining carboxyl groups are converted to an ammonium, sodium, or potassium salt.

2. The coal-water slurry of claim 1 which contains about 60 to about 80 percent solids by weight.

3. The coal-water slurry of claim 2 wherein the coal has a particle size such that about 60 percent to about 90 percent will pass through a 200 mesh U.S. standard sieve.

4. The coal-water slurry of claim 3 wherein the temperature of the slurry is maintained over a range of from about 2° C. to about 75° C.

5. A coal-water slurry containing from about 0.25 to 2.0 percent of a rheological additive consisting essentially of an esteramide of a trimer acid wherein approximately one-third to two-thirds of the carboxyl groups are esterified with a polyethylene glycol having a molecular weight of from about 3,000 to about 12,000 and a first portion of the remaining carboxyl groups are reacted with an aliphatic amine selected from the group consisting of 2-ethylhexylamine, dodecylamine, and N,N-dimethyl-1,3-diaminopropane; an alkanolamine selected from the group consisting of ethanolamine, diethanolamine, N-methyl ethanolamine, N-ethyl ethanolamine, isopropanolamine, diisopropanolamine, N-methyl isopropanolamine, N-ethyl isopropanolamine, and N-aminoethylethanolamine; or an etheramine selected from the group consisting of polyether monoamines of the formula $$R-(CH_2-\underset{\underset{R'}{|}}{CHO})_n-CH_2-\underset{\underset{CH_3}{|}}{CH}-NH_2$$

where R is a radical selected from the group consisting of n—$C_{10\text{-}12}H_{21\text{-}25}O$—, n—$C_4H_9OCH_2CH_2O$—, and $CH_3OCH_2CH_2O$—, R′ is hydrogen or methyl, and n is an integer such that the average molecular weight is in the range 300 to 1,000, polyether diamines of the formula $$H_2N\underset{\underset{CH_3}{|}}{CH}CH_2-(OCH_2\underset{\underset{CH_3}{|}}{CH})_xNH_2$$

where x is an integer such that the average molecular weight is in the range 200 to 1,000, polyether diamine of the formula $$H_2N-\underset{\underset{CH_3}{|}}{CH}-CH_2-(O-\underset{\underset{CH_3}{|}}{CH}-CH_2)_a-(O-CH_2-CH_2)_b-$$

$$-(O-CH_2-\underset{\underset{CH_3}{|}}{CH})_c-NH_2$$

where a, b, and c are integers greater than 1 such that the average molecular weight is in the range 500 to 6,000; and a second portion of the remaining carboxyl groups are converted to an ammonium, sodium, or potassium salts.

6. The coal-water slurry of claim 5 which contains about 60 to about 80 percent solids by weight.

7. The coal-water slurry of claim 6 wherein the coal has a particle size such that about 60 percent to about 90 percent will pass through a 200 mesh U.S. standard sieve.

8. The coal-water slurry of claim 7 wherein the temperature of the slurry is maintained over a range of from about 2° C. to about 75° C.

* * * * *